United States Patent [19]

Byrd, Jr.

[11] 4,203,455

[45] May 20, 1980

[54] LIQUID-COOLED SMOKING DEVICE

[76] Inventor: Erwin S. Byrd, Jr., 1202 Livingston St., Wheaton, Md. 20902

[21] Appl. No.: 942,127

[22] Filed: Sep. 13, 1978

[51] Int. Cl.[2] ..... A24F 1/30

[52] U.S. Cl. ..... 131/173; 131/180; 131/194

[58] Field of Search ..... 131/173, 180, 181, 194, 131/195, 225, 232

[56] References Cited

U.S. PATENT DOCUMENTS

| | | | |
|---|---|---|---|
| 3,881,499 | 5/1975 | McFadden et al. | 131/173 |
| 4,029,109 | 6/1977 | Kahler | 131/173 |
| 4,148,326 | 4/1979 | Harbraugh | 131/173 |
| 4,148,327 | 4/1979 | Graham | 131/173 |

*Primary Examiner*—Stephen C. Pellegrino
*Attorney, Agent, or Firm*—Haight & Huard

[57] ABSTRACT

A liquid-cooled smoking device includes a plurality of superposed chambers, the lowermost one of which defines an ash receptacle for collecting ash deposits entrained within the smoke. The receptacle is separated from the upper liquid-coolant chamber through which the smoke passes to be cooled. Concentrically arranged tubular members disposed within the liquid-coolant chamber define a sinusoidal smoke flow path within the coolant so as to cool the smoke to acceptable levels. A tobacco reservoir is operatively associated with the smoking bowl of the device so as to semi-automatically replenish consumed tobacco.

13 Claims, 1 Drawing Figure

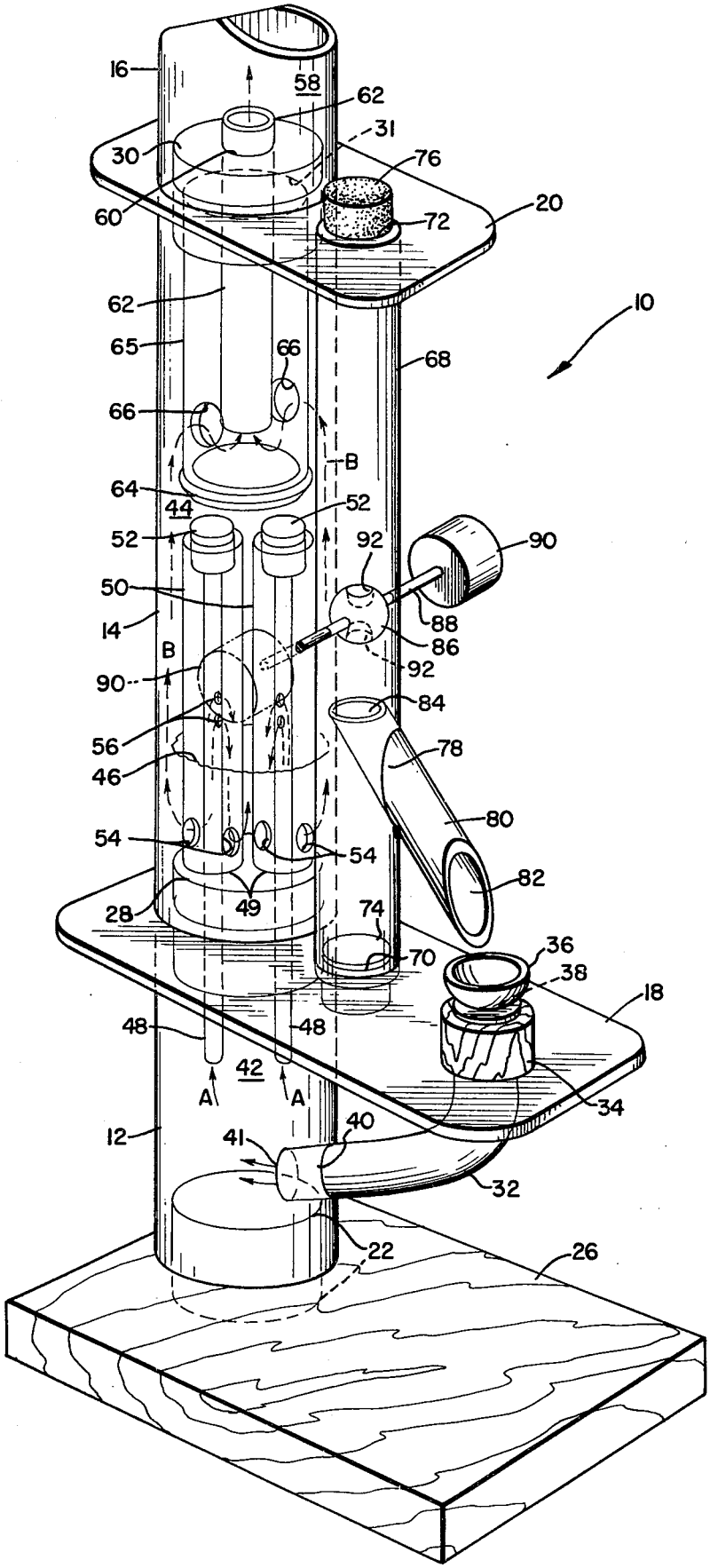
16
58
62
31
30
76
60
72
20
10
62
65
66
68
66
B
64
44
52
52
92
90
50
88
14
86
B
92
90
84
56
78
46
80
54
54
82
28
49
74
70
36
38
18
48
48
42
A
A
34
12
41
40
32
22
26

LIQUID-COOLED SMOKING DEVICE

FIELD OF THE INVENTION

The present invention relates generally to smoking devices and more particularly to liquid-cooled smoking devices which are especially adapted for use in connection with the smoking of rare and expensive tobaccos.

BACKGROUND OF THE INVENTION

Those familiar with the tobacco art and the correlative pipe apparatus are well aware of the fact that the smoke or fumes generated as a result of smoking rare and expensive tobaccos are characteristically harsh, hot and quite irritating to the lungs of the smoker. Within recent years, water pipes have become increasingly popular as a means for alleviating the aforenoted drawbacks of prior art pipe apparatus. In accordance with conventional water pipe apparatus, the smoke is conducted through a water chamber defined within the pipe so as to simultaneously filter the smoke with respect to any ash deposits or other contaminants present therein, as well as to cool the smoke. As a result, the adverse effects of the smoke are considerably mitigated and the smoking experience tends to be quite pleasurable.

A primary disadvantage characteristic of such conventional water pipes, however, has proven to be the fact that as the water chamber is the primary means employed for accomplishing the aforenoted cleansing process with respect to the ash and contaminant deposits present within the smoke and fumes, the filtering liquid tends to become rapidly contaminated with ash deposits and other combustion by-products. A need therefore exists with respect to conventional water pipe apparatus for the provision of a primary ash deposit filtering means or receptacle, wholly separate and distinct from the cooling liquid chamber, whereby substantial amounts of ash deposits, for example, can be removed from the smoke and fumes prior to the passing of the same through the water or liquid chamber. The primary function of the liquid chamber would then be the cooling of the smoke, with some residual or secondary ash and contaminant filtering.

Another disadvantage of such prior art water pipes is that although such pipes do in fact provide a liquid chamber in an attempt to cool the smoke and fumes, either the volume of the cooling chamber, or more particularly, the flow path for the smoke defined within the cooling chamber, is insufficient for in fact achieving such cooling. Consequently, the smoke inhaled by the smoker remains insufficiently cooled and is quite irritating to the smoker's throat and lung passages.

Lastly, it has also been observed that in conjunction with conventional water pipes and particularly the bong variety thereof, there is presently no provision within such conventional pipes for means which is capable of periodically supplying a predetermined amount of fresh tobacco to the smoking bowl of the apparatus in order to replenish consumed tobacco. A need therefore exists, for example, for a semi-automatic device which would be manually manipulative in order to obviate the requirement of the smoker to ordinarily interrupt his smoking activity for a substantial period of time so as to otherwise accomplish the tobacco replenishment task.

OBJECTS OF THE INVENTION

Accordingly, it is an object of the present invention to provide a new and improved fluid-cooled smoking device.

Another object of the present invention is to provide a new and improved fluid-cooled smoking device which effectively overcomes the disadvantages characteristic of prior art smoking devices.

Still another object of the present invention is to provide a new and improved liquid-cooled smoking device which effectively provides operative structural features presently lacking within conventional smoking devices whereby the utility and service life of the smoking device is substantially improved and enhanced.

Yet another object of the present invention is to provide a new and improved liquid-cooled smoking device wherein ash deposits and contaminants would be substantially removed prior to conducting the smoke through the liquid cooling chamber so as to prevent the rapid fouling of the cooling liquid.

A further object of the present invention is to provide a new and improved liquid-cooled smoking device wherein the cooling liquid is provided primarily for smoke cooling purposes and secondarily for residual smoke-filtering purposes.

A still further object of the present invention is to provide a new and improved liquid-cooled smoking device wherein the smoke flow path through the cooling liquid is sinusoidally defined so as to effectively elongate the smoke flow path through the cooling chamber and thereby provide adequate cooling of the smoke prior to the same being inhaled by the smoker.

A yet further object of the present invention is to provide a new and improved liquid-cooled smoking device wherein the ash deposits and contaminants are collected within a chamber provided within the smoke flow path upstream of the liquid cooling chamber so as to readily permit access to the ash chamber or receptacle in order to facilitate cleaning of the same.

A yet additional object of the present invention is to provide a new and improved liquid-cooled smoking device wherein the liquid is maintained within a sealed tube portion so as to render the device spillproof.

An additional object of the present invention is to provide a new and improved liquid-cooled smoking device wherein tobacco refill means is provided in conjunction with the smoking bowl so as to periodically facilitate the convenient replenishing of the tobacco supply within the smoking bowl.

Still yet another object of the present invention is to provide a new and improved liquid-cooled smoking device which is characterized by means of a relatively simplified structure which is also relatively inexpensive to manufacture.

SUMMARY OF THE INVENTION

The foregoing and other objectives are achieved in accordance with the present invention through the provision of a liquid-cooled smoking device which comprises a plurality of vertically disposed tubular members defining a plurality of serially connected fluid chambers. The tubular members are separated by and supported upon horizontally disposed plates, with the smoking bowl of the device being supported upon the lowermost plate. A flexible tube fluidically connects the smoking bowl to the lowermost chamber which defines an ash receptacle, while additional tubular members, having perforations defined therein, fluidically connect the lowermost chamber with an upper, liquid chamber. The perforated tubular members are concentrically arranged so as to define a sinusoidal smoke flow path through the cooling liquid and another perforated tubular member is also provided so as to fluidically interconnect the liquid chamber and the uppermost chamber.

A tobacco supply hopper or reservoir, in the form of another tubular member, is supported between the horizontal plates so as to extend in the vertical direction and a tobacco supply chute is operatively associated with the hopper so as to supply a predetermined amount of tobacco therefrom to the smoking bowl. A rotatable trap-chamber type valve is operatively supported within the hopper so as to supply the predetermined amount of tobacco from the hopper to the supply chute.

BRIEF DESCRIPTION OF THE DRAWING

Various other objects, features and attendant advantages of the present invention will be more fully appreciated as the same becomes better understood from the following detailed description when considered in conjunction with the accompanying drawing wherein:

The sole FIGURE is a perspective view of the liquid-cooled smoking device construction in accordance with the present invention and showing its cooperative parts.

DETAILED DESCRIPTION OF THE ILLUSTRATED EMBODIMENT

Referring now to the drawing, the liquid-cooled smoking device of the present invention is shown and is generally indicated by the reference character 10. As seen, the smoking device comprises three vertically extending, co-axially arranged tubular members 12, 14 and 16 and a pair of flat plates 18 and 20, respectfully, interposed between the ends of the tubular members. The tubular members and flat plates may be fabricated, for example, from plexiglas and it is seen that the lowermost tube 12 has a rubber cork 22 frictionally engaged within the lower, open end thereof so as to seal the same. A rectangularly shaped wooden base 24 is provided with a circular recess, not shown, so as to receive the lower end of cork 22 while the lower end face of tubular member 12 rests upon the upper surface 26 of base 24.

Plate 18 is provided with a circular aperture, not shown, and another rubber cork 28, frictionally engaged within the upper end of tube 12 and the lower end of tube 14 so as to seal the joint defined therebetween, passes through the plate aperture. In this manner, plate 18 is supported upon the upper end of tube 12 while the lower end of tube 14 is, in turn, supported upon plate 18. In a similar manner, plate 20 is likewise provided within a circular aperture, also not shown, and a rubber cork 30, frictionally engaged within the upper end of tube 14 and the lower end of tube 16 so as to seal the joint defined therebetween, passes through the plate aperture. As a result of such interrelated structural elements, plate 20 is supported upon the upper end of tubular member 14 while the lower end of tubular member 16 is, in turn, supported upon plate 20. The upper end of tubular member 16 is retained open so as to serve as the mouthpiece for the smoker as will become more apparent hereinafter.

Lower plate 18 is provided with an additional aperture, not shown, formed within the vicinity of the edge portion thereof located at the free cantilevered end, and one end of an arcuately shaped, elbow-type tube 32 projects upwardly therethrough. A smoking bowl support 34, having an axial bore, not shown, defined therein for fluidically communicating with tube 32, is seated upon the upper projecting end of tube 32 and a smoking bowl 36 is, in turn, seated upon support 34. The bowl 36 is, of course, hollow so as to retain a supply of tobacco therein, and the bowl may have an elliptical, hemispherical, or similar configuration. The bottom of the bowl 36 is provided with an aperture 38, shown in phantom, so as to fluidically communicate with support 34 and tube 32, and the bowl support 34 may rest upon the upper surface of plate 18 so as to enhance the stability of the entire bowl assembly.

The lower end of tubular member 12 is provided with an aperture 40 at a level just above the upper surface of rubber cork 22 so that the latter does not interfere with the accessibility of the aperture and the other, downwardly inclined end of tube 32 passes through aperture 40 so that the tubular opening 41 is disposed interiorly of tube 12. As may thus be appreciated, during the smoking process, smoke is conducted directly into tube 12 from bowl 36 and tube 32. Ashes and other contaminants present within the smoke may thus be gravitationally directed into a chamber 42, defined by tubular member 12 and rubber corks 22 and 28, which serves as an ash receptacle. As deposits collected within chamber 42 may be periodically removed therefrom by simply removing the device 10 from the base 24 and, in turn, removing the rubber cork 22 from the lower end of tubular member 12.

The chamber 44, defined by tubular member 14 and rubber corks 28 and 30, serves as the smoke cooling chamber and in accordance with the present invention, is adapted to have a predetermined amount of liquid coolant, such as, for example, water 46, housed therein. In order to provide for fluidic communication between chambers 42 and 44 so as to permit the smoke to travel from chamber 42 toward the smoker, rubber cork 28 is provided with a pair of through-bores, not shown, through which a pair of tubes 48 extend, the opposite ends of the tubes being disposed within chambers 42 and 44. The upper portion of cork 28 is also provided with a pair of counterbored, blind bores or recesses 49 and a pair of tubes 50 are concentrically disposed about the upper portions of the tubes 48 such that the lower ends of tubes 50 are sealingly disposed within bores 49 of cork 28. The upper ends of tubes 50 have additional rubber corks or stoppers 52 sealingly disposed therein and the stoppers 52 are similarly provided with blind bores, not shown, within the lower ends thereof in order to sealingly receive the upper ends of tubes 48.

The lower ends of tubes 50 are provided with apertures 54 defined within the sidewall portions thereof and tubes 48 are likewise provided with apertures 56 within the upper sidewall portions thereof at a level higher than that of apertures 54. In this manner, when water 46 is provided within chamber 44 so as to have a depth greater than the elevational level of apertures 54, but less than the level of apertures 56, the water will be present within the chamber region defined between tubes 50 and tubular member 14. In addition, the water will enter apertures 54 and be present within the chamber region defined between tubes 50 and 48. However, as a result of the sealing function of stopper 28, as well as in view of the fact that apertures 56 are at a level above the level of water 46, no water will enter chamber 42. This is true even when the device is tilted or knocked down, as apertures 56 are inwardly directed towards the central axis of second chamber 44 and the amount of water present within the device is insufficient to fill tubes 50 to a sufficient degree to force coolant through apertures 56 and into chamber 42. As a result of the foregoing structure, it will also be apparent that the smoke within chamber 42 is then permitted to travel upwardly through tubes 48, as shown by arrows A, pass through apertures 56 and enter the water chambers defined between tubes 48 and 50, pass through apertures 54 and enter the water chambers defined between tubes 50 and 14, and ultimately enter and flow through the upper regions of chamber 44 as shown by arrows B. It is to be noted that, in accordance with the present invention, an important feature of the aforenoted structure is that a sinusoidal smoke flow-path is defined within the liquid coolant. This elongated cooling flow path suffices to provide the desired level of cooling for the smoke.

Lastly, in order to complete the smoke flow-path from chamber 44 to the uppermost, open chamber 58 defined by tubular member 16 and stopper 30, so as to in turn permit the smoke to be discharged from the mouthpiece of tubular member 16, stopper 30 is provided with through-bore 60 through which passes an open-ended tubular member 62 similar to tubes 48. The underside of stopper 30 is provided with a recess 31, similar to recesses 49, and a tube 65 is concentrically disposed about tubular member 62 such that the upper end of tube 65 is sealingly disposed within recess 31 of stopper 30. The lower end of tube 62 is sealed by means of rubber stopper 64 similar to stopper 52. The medial portion of tube 65 is provided with apertures 66 defined within the sidewall portions thereof, and in this manner, fluidic communication is provided between chamber 44 and the interior of tube 65. Apertures 66 are located near the bottom of tubular member 62, so that smoke entering the apertures from chamber 44 will rise and enter member 62. The smoke will then pass through tubular member 62, and be discharged toward the mouthpiece end of tubular member 16 so as to be inhaled by the smoker. Stopper 30 and tubes 14 and 16 will serve to fix the axial position of stopper 64 and tubular member 65. Similarly, the axial position of tube 65 is partially defined by means of its frictional engagement within cork 30 and the axial disposition of stopper 64 is also partially defined by means of its engagement with tube 65.

As the tobacco disposed within smoking bowl 36 is consumed, the supply of the same must of couse be replenished if smoking of the tobacco is to be continued. In order to obviate the necessity of the smoker from retrieving a new supply of tobacco from a remote tobacco reservoir, the present invention further comprises the disposition of a tobacco reservoir or hopper within the vicinity of the smoking bowl. In addition, the reservoir or hopper structure is uniquely cooperative with the smoking bowl so as to effectively semi-automatically supply a predetermined amount of fresh tobacco to the smoking bowl as may be required due to continuous consumption of the tobacco.

In accordance with the present invention, the tobacco reservoir or hopper apparatus is seen to comprise a tubular reservoir 68 interposed between upper and lower horizontal plates 20 and 18. The reservoir is also interposed between tubular member 14 and the smoking bowl assembly in a substantially co-planar array. Plates 18 and 20 are provided with apertures 70 and 72 through which project rubber stoppers 74 and 76 in order to seal the open ends of tubular reservoir 68. Reservoir 68 is thus seen to have its lower end supported upon plate 18 while plate 20 is, in turn, supported upon the upper end of reservoir 68.

Within a medial, sidewall portion of reservoir 68 which is disposed toward the smoking bowl assembly, there is provided an aperture 78 within which is disposed an inclined tubular member 80. The upper end of member 80 is disposed interiorly of the reservoir 68, while the lower end of member 80 is disposed exteriorly of reservoir 68 and above smoking bowl 36. As will become apparent hereinafter, member 80 serves as a tobacco supply chute for delivering a fresh supply of tobacco from reservoir 68 to bowl 36. In order to accomplish this function, it is seen that the discharge opening 82 defined within the lower end of the chute 80 is disposed substantially within a vertical plane coaxial with smoking bowl 36, while the intake opening 84 defined within the upper end of chute 80 is disposed substantially within a horizontal plane.

A rotary valve member 86 is disposed internally of reservoir 68 at an axial position above the intake opening 84 of supply chute 80, valve 86 being fixedly secured upon a rotary axle 88. Axle 88 is rotatably supported within sidewall portions of reservoir 68 and the same projects outwardly through reservoir 68 such that the ends are disposed externally thereof. Manually manipulative knobs 90 are fixedly secured to the ends of axle 88 and in this manner, the valve 86 may be rotated to perform its valving function.

It will be appreciated that valve 86 is of the trap-chamber type and in accordance therewith, the valve comprises a substantially spherical body having a pair of diametrically opposed hemispherical recesses 92 defined within the upper and lower surface areas thereof as viewed in the FIGURE. The portion of reservoir 68 defined above valve 86 is adapted to be filled with fresh tobacco and the diameter of valve 86 is substantially equal to the interior diameter of reservoir tube 68 in order to prevent any tobacco from passing between valve 86 and the interior walls of reservoir 68. Consequently, tobacco from reservoir 68 can only be housed within the upper recess 92, while any tobacco previously housed within the lower recess 92 will have been discharged into chute 80. As the tobacco within smoking bowl 36 is consumed and the need arises to replenish the same, the rotary valve mechanism is rotated by means of knobs 90. The upper recess 92 having a fresh supply of tobacco therein will therefore now come into the lower position so as to discharge its supply of tobacco into chute 80 and bowl 36 and the lower recess 92 will move into the upper position so as to be refilled with a new charge of tobacco. It is thus seen that new supplies of tobacco, of predetermined amounts defined by the volume of valve recesses 92, may be continuously semi-automatically transmitted to the smoking bowl 36 as required.

Obviously, many modifications and variations of the present invention are possible in light of the above teachings. It is therefore to be understood that within the scope of the appended claims, the present invention may be practiced otherwise than as specifically described herein.

What is claimed is:

1. A liquid-cooled smoking device comprising:

housing means for defining at least two, vertically superposed chambers;

means for containing a supply of tobacco to be smoked;

means interconnecting said tobacco container and a first upstream one of at least two chambers for introducing smoke into said first chambers;

a second downstream chamber having a liquid coolant disposed therein;

means fluidically connected with said second chamber for withdrawing said smoke from said device;

means sealingly separating said first and second chambers; and means within said second chamber for defining a sinusoidal liquid-cooling smoke flow path, said sinusoidal means including at least one pair of concentric tubes, the inner one of said concentric tubes having at least one aperture in its wall, said inner tube aperture facing the central axis of said second chamber and positioned at an elevational level above the surface of said coolant, the outer one of said concentric tubes having at least one aperture in its wall, said outer tube aperture positioned at an elevational level below the surface of said coolant, said separating means and said sinusoidal means acting together to permit said smoke to travel from said first chamber to said second chamber by said flow path and to prevent said coolant from entering said first chamber.

2. The smoking device as set forth in claim 1, wherein:

said smoke introducing means comprises a substantially downwardly directed tube so as to facilitate the gravitational movement of any ash deposits entrained within said smoke into said first chamber.

3. The smoking device as set forth in claim 2, wherein:

said second chamber is disposed above said first chamber.

4. The smoking device as set forth in claim 1, wherein said separating means comprises:

a rubber stopper interposed between said first and second chambers.

5. A smoking device as set forth in claim 4, wherein:

said inner tube extends from said first chamber, through said rubber stopper, and into said outer tube, said outer tube being disposed solely within said second chamber.

6. The smoking device as set forth in claim 1, wherein said housing means comprises:

a plurality of co-axially aligned tubular members; and a plurality of horizontally disposed plates separating said tubular members.

7. The smoking device as set forth in claim 6, further comprising:

tobacco reservoir means mounted upon said plates for supplying predetermined amounts of tobacco to said tobacco containing means.

8. The smoking device as set forth in claim 1, further comprising:

tobacco reservoir means operatively associated with said tobacco containing means for supplying predetermined amounts of tobacco to said tobacco containing means as said tobacco within said containing means is consumed.

9. The smoking device as set forth in claim 8, wherein:

said tobacco reservoir means is manually manipulative.

10. The smoking device as set forth in claim 8, wherein:

said tobacco reservoir means semi-automatically supplies said predetermined amounts of tobacco to said containing means.

11. The smoking device as set forth in claim 8, wherein said reservoir means comprises:

a tobacco hopper;

a supply chute for conducting tobacco from said hopper to said tobacco containing means; and a rotary, trap-chamber type valve means for controlling the amount of tobacco supplied from said hopper into said chute, said valve means including at least one knob and a spherical rotary valve member having oppositely disposed hemispherical recesses for supplying each of said predetermined amounts.

12. The smoking device as set forth in claim 9, further comprising a plurality of horizontally disposed plates, a first one of said plates connecting said reservoir means to said housing means and a second one of said plates connecting said reservoir means to both said housing means and said containing means, said connections maintaining said reservoir means in a fixed position relative to both said housing means and said containing means.

13. The smoking device as set forth in claim 1, wherein said device further comprises an open chamber disposed above said second chamber, a stopper sealingly separating said open chamber from said second chamber, and means for fluidically connecting said open chamber and second chamber, said connecting mean including means for permitting smoke to travel from said second chamber into said open chamber and preventing said coolant from entering said open chamber.

* * * * *